US006397649B1

(12) United States Patent
Naber

(10) Patent No.: US 6,397,649 B1
(45) Date of Patent: Jun. 4, 2002

(54) KEYHOLE BARRIER SYSTEM AND METHOD

(76) Inventor: Daniel A. Naber, 13463 78th Pl. N., West Palm Beach, FL (US) 33412

( * ) Notice: Subject to any disclaimer, the term of this patent is extended or adjusted under 35 U.S.C. 154(b) by 0 days.

(21) Appl. No.: 09/627,690

(22) Filed: Jul. 28, 2000

(51) Int. Cl.[7] ..... E05B 27/00; E05B 27/02

(52) U.S. Cl. ..... 70/428; 70/409; 70/381; 40/330

(58) Field of Search ..... 70/423, 424, 427, 70/428, 429, 430, 389, 390, 356, 409, 380, 381, 360, 375, 422, 369, 358, 384, 395; 40/330; 33/599

(56) References Cited

U.S. PATENT DOCUMENTS

| | | | | | |
|---|---|---|---|---|---|
| 1,573,791 | A | | 2/1926 | Roethlisberger | 70/395 |
| 1,696,326 | A | | 12/1928 | Roethlisberger | 70/428 |
| 1,728,310 | A | | 9/1929 | Sundel | 70/428 |
| 3,276,233 | A | | 10/1966 | Russell et al. | 70/382 |
| 3,408,842 | A | | 11/1968 | Barnes et al. | 70/424 |
| 4,120,184 | A | | 10/1978 | Gerlach | 70/389 |
| 4,161,871 | A | * | 7/1979 | Ziegler | 70/356 |
| 4,417,410 | A | * | 11/1983 | Freedom | 40/330 |
| 5,168,734 | A | * | 12/1992 | Duval et al. | 70/369 |
| 5,697,239 | A | * | 12/1997 | Hanneman et al. | 70/493 |
| 5,964,111 | A | * | 10/1999 | Lambert | 70/493 |

* cited by examiner

*Primary Examiner*—Tan Nguyen
*Assistant Examiner*—Dalena Tran
(74) *Attorney, Agent, or Firm*—Akerman Senterfitt

(57) ABSTRACT

A keyhole barrier system for use with tumbler locks containing a keyway and a plurality of tumblers. The system contains a keyhole block having both retention and signaling portions. The retention portion prevents removal of the keyhole block from the lock by providing a locking surface for the lock tumblers. The signaling portion extends outwardly from the keyway preferably substantially parallel to the retention portion. The system can further include an extractor having both insertion and handle portions. The extractor facilitates removal of the installed keyhole block by raising the tumblers locked against the keyhole block. Further, the handle portion and the signaling portion can form a retraction aid to facilitate removal of the system from a keyway. A method for forming a keyhole barrier system for use in tumbler locks includes providing a keyhole block having a laterally visible signaling portion and a retention portion in which the retention portion comprises an elongated portion, a locking surface and a tip. The method also includes inserting the keyhole block into the tumbler lock and allowing at least one pin from the lock to drop behind the locking surface. The lock cannot be operated by a conventional key with the keyhole block installed.

31 Claims, 6 Drawing Sheets

KEYHOLE BARRIER SYSTEM AND METHOD

CROSS REFERENCE TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

1. Technical Field

The present invention relates generally to a system and method for securing tumbler locks. More particularly, the invention relates to a keyhole barrier system and method which prevents the operation of a tumbler lock.

2. Description of the Related Art

A conventional tumbler lock system allows any user with a matching key to operate the lock. Under normal conditions, operation of the lock by authorized individuals is completely appropriate. There are circumstances, however, in which it is necessary to prevent a normally authorized individual from accessing an area which may be entered through a door having a tumbler lock. For example, when a house is being fumigated, the owners of the home are not permitted to enter the premises for a period of time. Exclusion from the house is required to prevent exposure to harmful residual chemicals resulting from the fumigation procedure. Once the chemicals have dissipated, it is safe for the owners to return. A keyhole barrier system plays an important role in preventing the owners from entering during the harmful period.

It is known to insert a keyhole block into a door to prevent individuals from entering an area, including those individuals who possess the proper key. For example, U.S. Pat. Nos. 1,573,791 and 1,696,326 to Roethlisberger, U.S. Pat. No. 1,728,310 to Sundel, U.S. Pat. No. 3,276,233 to Russell et al., and U.S. Pat. No. 3,408,842 to Barnes et al. all disclose keyhole blocking devices for tumbler locks. Notably, the Roethlisberger, Russell and Barnes devices contain a keyhole block portion which is completely inserted into the keyhole and is invisible from the outside of the lock when installed. Thus, no portion of these keyhole blocks can serve as a visible warning device to an individual attempting to open the lock. Therefore, what is needed is a keyhole barrier system which integrates a warning device into the keyhole block portion of the system.

SUMMARY OF THE INVENTION

It is an object of the present invention to provide a keyhole barrier system which prevents individuals from entering an area which is unauthorized.

It is another object of the present invention to integrate a warning device into the keyhole barrier system to prevent individuals from entering a hazardous area, such as a room that has recently been fumigated, thereby preventing exposure to a harmful environment.

It is a still further object of the present invention to integrate the warning device into a portion of the system which blocks a tumbler lock, thereby preventing removal of the warning device from the lock.

Other objectives and applications of the present invention will become apparent from the following description contained in the accompanying specification. The preferred embodiments are not intended to be limiting, but are solely for illustrative purposes.

In accordance with the invention, a keyhole barrier system for use with tumbler locks is provided. The system can be used on tumbler locks having a keyway, a plurality of tumblers in the keyway and a lock surface outside of and surrounding an opening of the keyway. The system includes a keyhole block having a retention portion and an external signaling portion. The retention portion can contain an angled tip and also a longitudinal axis and can be designed to prevent the removal of the keyhole block from the tumbler lock once the retention portion is installed in the keyway. The retention portion can be inserted into a tumbler lock along a longitudinal axis of the keyway. The signaling portion can extend from the retention portion of the keyhole block in a non-perpendicular manner. Further, when the keyhole block is installed into a keyway, the signaling portion can extend outwardly from the keyway and provide a readily observable warning to approaching observers that the keyhole is blocked.

The signaling portion of the present invention can provide a warning for individuals approaching the lock. The signaling portion preferably has a height greater than either the axial height of the retention portion or the elongated height of the retention portion. When the keyhole block is inserted into the lock, the signaling portion can extend substantially parallel to the longitudinal axis of the retention portion. Also, the signaling portion can be visible laterally relative to a longitudinal axis of the retention portion. Further, the signaling portion can extend substantially perpendicular to the lock surface. Such a signaling portion can be of unitary construction with the keyhole block, such as an extension of the retention portion projecting outward from the lock when the keyhole block is installed.

The signaling portion can comprise attachment structure containing, for example, an aperture or a label mount. A warning label can be affixed directly to the signaling portion of the present invention. In one embodiment, a warning label, such as a sticker, can be affixed to the signaling portion extension. The signaling portion may also contain a label mount. The label mount can take the form of an aperture through which a label is attached. The label mount may be used to attach warning labels of different sizes and shapes to the signaling portion. This label mount may be used, for example, to attach warning labels informing unauthorized individuals not to enter an area recently fumigated.

The present invention can also contain an extractor to facilitate removal of the keyhole block. The extractor can be used to displace the tumblers of the lock in order to facilitate removal of the keyhole block from the tumbler lock. The extractor can have a handle portion and a center edge. The extractor can matingly interfit with the keyhole block during retraction of the keyhole block from the keyway. The handle portion and the signaling portion can, in combination, form a retraction aid, thereby facilitating removal of the keyhole block from the keyway. Additionally, the system can include fastening structure for keeping the system components in close proximity to each other when not installed.

A method for forming a barrier in a tumbler lock keyhole is also provided. The method includes a keyhole block having a retention portion and a signaling portion. The retention portion can be comprised of an elongated portion, a locking surface and a tip. The retention portion can be inserted along a longitudinal axis of the keyway. The signaling portion can extend outward from the tumbler lock substantially parallel to the retention portion once the keyhole block is installed. The method further comprises inserting the keyhole block into the tumbler lock and allowing at least one pin from the tumbler lock to drop behind the tip of the retention portion and lock in place. Thus, the tumbler lock cannot be operated using a conventional key once the keyhole block is in place. Additionally, the method comprises a signaling portion which serves as a visible warning to individuals approaching the lock. A label mount can be provided with the signaling portion for attaching warnings regarding the installation of the keyhole block.

An extractor having a handle portion can also be provided. The extractor can matingly interfit with the retention portion and displace the pins which have locked against the locking surface of the keyhole block. Further, the handle portion and the signaling portion can engage to form a retraction aid. A user can grip the retraction aid to remove the system from a keyway. Fastener means can also be provided to keep the signaling portion and the handle portion in close proximity to each other when the system is not installed.

BRIEF DESCRIPTION OF THE DRAWINGS

There are presently shown in the drawings embodiments which are presently preferred, it being understood, however, that the invention is not limited to the precise arrangements and instrumentalities shown.

DETAILED DESCRIPTION OF THE INVENTION

The present invention provides a keyhole barrier system and method for use in conjunction with tumbler locks. The invention prevents unauthorized individuals from operating a tumbler lock once the system is installed. Any type of tumbler lock is acceptable for use with the invention, such as a pin tumbler lock, a disc tumbler lock or a sidebar tumbler lock. Although the figures illustrate the present invention in operation with a pin tumbler lock, it is understood that the figures are intended to be for illustrative purposes only. Accordingly, it is understood that the invention can be applied to any type of tumbler lock.

Figure 1:
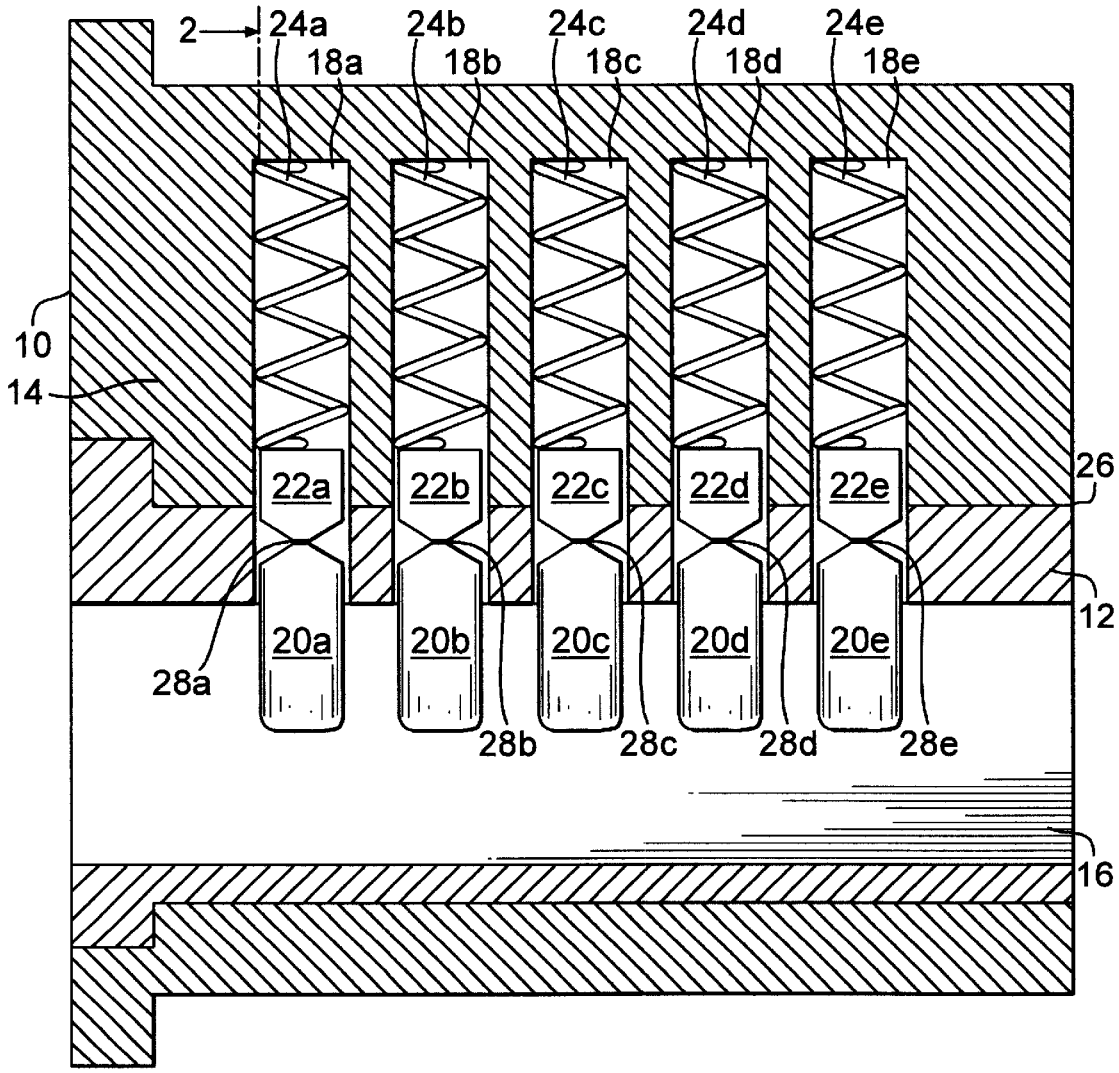
FIG. 1 (PRIOR ART)
FIG. 1 shows a cross-sectional side view of a tumbler lock for use with the present invention.
Figure 2:
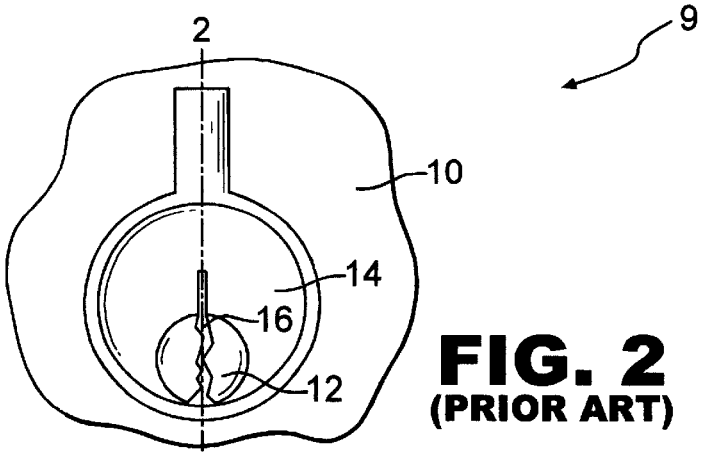
FIG. 2 (PRIOR ART)
FIG. 2 shows a cross-sectional end view of the tumbler lock of FIG. 1.

FIGS. 1 and 2 show a conventional pin type tumbler lock 10, which typically includes a rotatable lock cylinder 12 rotatable within a lock casing 14, and an axial keyway 16 located within the lock cylinder 12. The lock 10 can also include pinsets 18*a*–18*e*, which are preferably spring mounted and extend radially inward from the keyway 16. Each pinset 18*a*–18*e* can have a corresponding cylinder pin 20*a*–20*e* which contacts a key (not shown) during normal operation. Each pinset 18*a*–18*e* further comprises a casing pin 22*a*–22*e* which acts to mount a compression spring 24*a*–24*e*. The compression springs 24*a*–24*e* maintain tension on the cylinder pins 20*a*–20*e* and allow for smooth operation of the lock. The lock 10 also contains parting lines 28*a*–28*e*, which are the points where a cylinder pin 20*a*–20*e* meets the corresponding casing pin 22*a*–22*e*. An axial rotation line 26 is located at the outermost portion of the lock cylinder 12 through which the pinsets 18*a*–18*e* are installed. The lock 10 also has an lock surface 9 which is the portion of the lock 10 visible to an individual when approaching the lock 10 while the lock 10 is installed in a door, drawer or any other area. The lock surface 9 is illustrated in FIG. 2 and comprises the portions of the lock cylinder 12 and the lock casing 14 visible when the lock 10 is installed into a door.

To operate the lock, the correct key (not shown) should be inserted into the keyway 16. When the correct key is inserted into the keyway 16, the pinset parting lines 28*a*–28*e* will be aligned with an axial rotation line 26 of the lock 10 allowing the rotatable lock cylinder 12 to rotate freely 360° between the locked and unlocked positions of the lock 10. If the correct key is not inserted into the lock, the springs 24*a*–24*e* bias the pins 20*a*–20*e* to block the parting line 26 and prevent rotation of the lock cylinder 12.

Figure 3:
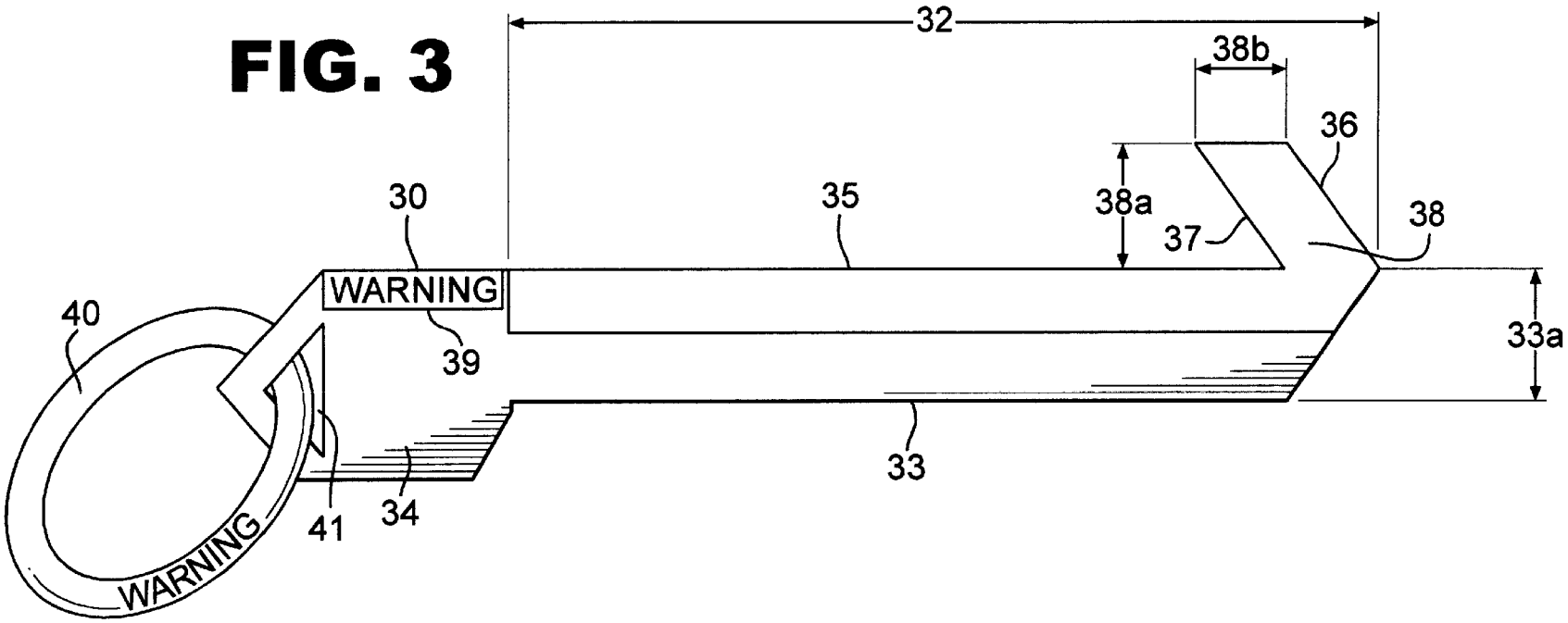
FIG. 3 shows a side view of a keyhole block according to the invention.

FIG. 3 presents a keyhole block 30 in accordance with the invention. The keyhole block 30 includes a retention portion 32. After the keyhole block 30 is installed in the lock 10, the retention portion 32 prevents removal of the keyhole block 30 from the keyway 16 of the lock 10. The keyhole block 30 also contains a signaling portion 34. The signaling portion 34 projects outward from the keyway 16 to provide a warning to individuals approaching the lock 10 that the lock 10 is blocked. The signaling portion 34 has a height 34*a* that is preferably greater than either the radial height 38*a* or the elongated portion height 33*a* thereby allowing the signaling portion 34 to be visible to an individual approaching the lock 10 laterally (i.e. from the side of the lock), from directly in front of the lock 10 or from any other direction of approach in between the side and the front of the lock 10. Furthermore, a label or warning device can be unitarily constructed into the signaling portion 34 of the keyhole block 30.

The retention portion 32 contains an elongated portion 33 and a tip 38. The elongated portion 33 has a height 33*a* and can contain structure to facilitate insertion of the retention portion 32 into the keyway 16, such as grooves. The leading edge 36 of the tip 38 may be angled. The angle of the leading edge 36 can be between zero and ninety degrees, but preferably has a declination of between thirty and sixty degrees. Most preferably, the leading edge 36 is at an angle of approximately forty-five degrees. A forty-five degree angle of the leading edge 36 is preferred because it is particularly effective at raising the pinsets 18*a*–18*e*.

The tip 38 has a radial height 38*a* which is the distance from the center edge 35 of the elongated portion 33 to the point of the tip 38 furthest from the center edge 35. If the radial height 38*a* is too small, the tip 38 will not provide a locking surface 37 which is sufficient to lock against any of the pins 18*a*–18*e*, and will not prevent removal of the keyhole block 30 from the lock 10. Therefore, the radial height 38*a* should be substantial enough to provide a locking surface 37 that secures the keyhole block 30 in place upon insertion of the keyhole block 30 into the lock 10. A sufficient radial height allows a predetermined number of pins 18*a*–18*e* from the lock 10 to drop into position behind the tip 38 and prevent removal of the keyhole block from the keyway 16.

The tip 38 has an axial length 38*b*. Preferably, the axial length 38*b* is sufficient to allow at least one pin, for example 20*a*, to drop into place behind the tip 38. If the axial length 38*b* is too long, the pins 18*a*–18*e* in the lock 10 may not be free to drop into place behind the tip 38 and the lock 10 may not be secured in the desired fashion.

The keyhole block 30 further contains an extended signaling portion 34. The signaling portion 34 can provide a mounting surface or mounting area for a warning device. The signaling portion 34 can be an extension of the elongated portion 33 incorporated during manufacturing of the keyhole block 30. It is understood that the signaling portion 34 can be any structure suitable for providing a laterally visible warning to an individual attempting to operate the lock 10. Examples of a warning device can include a sticker 39 affixed to the signaling portion 34 or a hanging warning label 40 attached to the signaling portion 34. In a preferred embodiment, a warning label can be attached or connected to the signaling portion 34 in any suitable manner, such as with adhesive or any suitable mechanical attachment structure. Additionally, the signaling portion 34 can contain an aperture 41. The aperture 41 can be used to attach a warning label 40 or other attachment means such as a keyring or a wrist leash.

Figure 4:
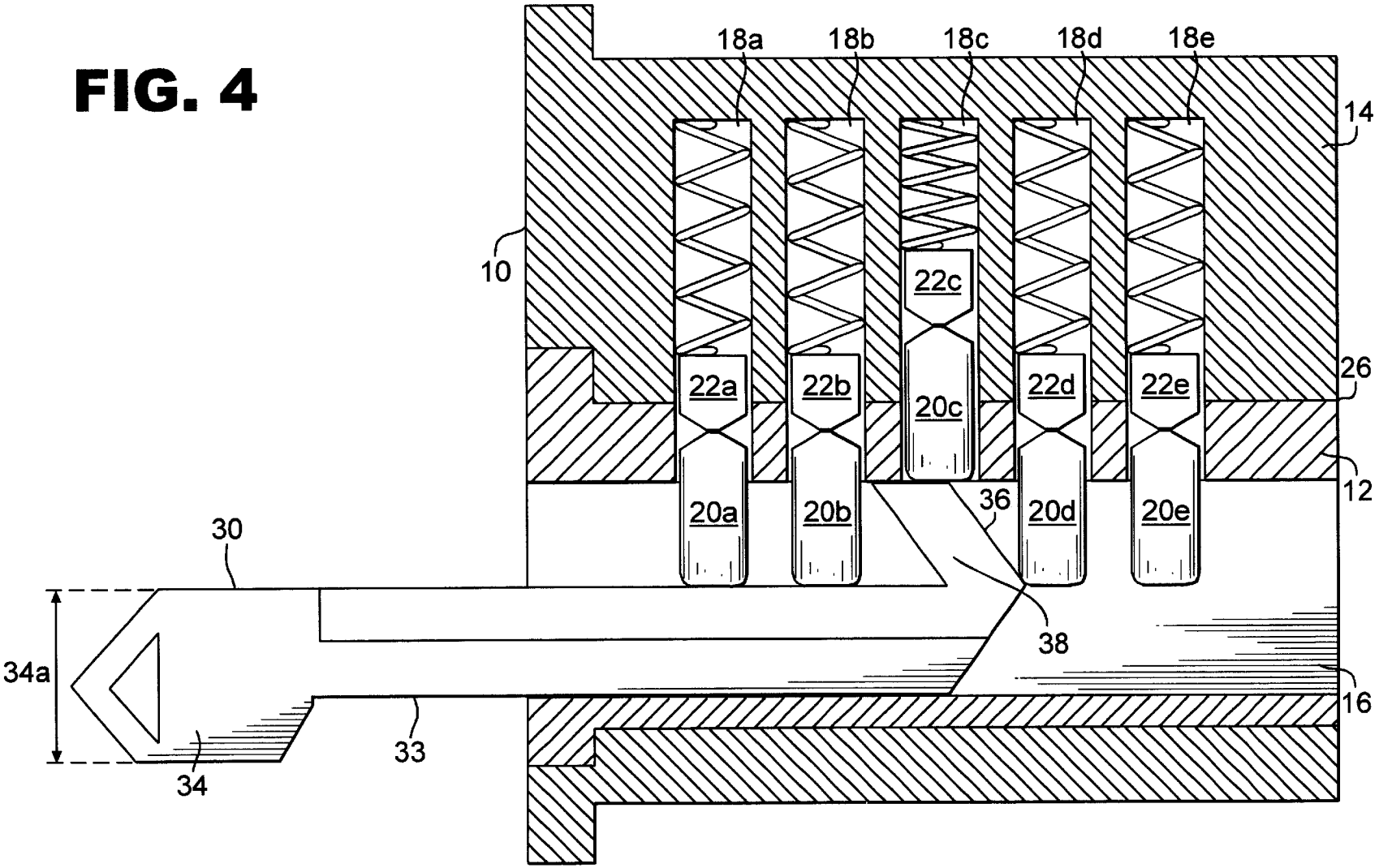
FIG. 4 shows a side view of the block of FIG. 3 during insert ion into a lock.
Figure 5:
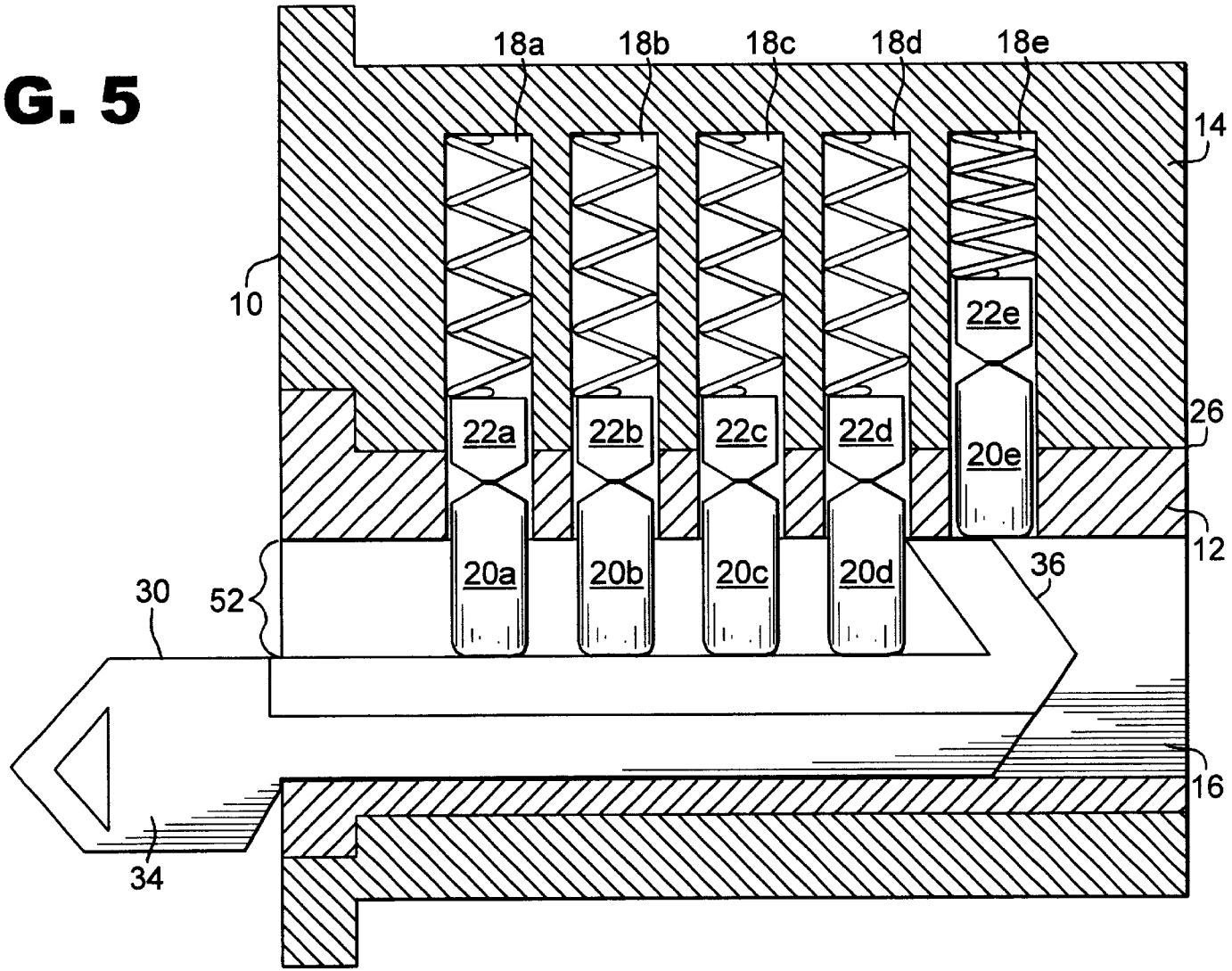
FIG. 5 shows a side view of the block of FIG. 3 inserted into a lock.

FIGS. 4 and 5 illustrate the operation of the keyhole block 30 according to the present invention. During insertion, the angled tip 38 of the keyhole block 30 raises pins 20*a*–20*e* associated with pin sets 18*a*–18*e*. As the keyhole block 30 slides past each pin 20*a*–20*e*, those pins 20*a*–20*e* which are no longer supported by the tip 38 on drop back into place behind the tip 38. In FIG. 4, the keyhole block 30 is being inserted into the keyway 16 of the lock 10. In this example, the keyhole block 30 is seen raising the pin 20*c*. The pins 20*a* and 20*b* have already passed the tip 38 and have fallen back into place. The tip 38 of the retention portion 32 is approaching the pin 20*d*. FIG. 5 shows the keyhole block 30 completely inserted into the lock 10. In this example, the axial length the axial length 38*b* of the tip 38 allows the pins 20*a*–20*d* to fall behind the tip 38. The lock 10 cannot be operated because the pins 20*a*–20*d* are locked against the locking surface 37 of the tip 38.

Figure 6:
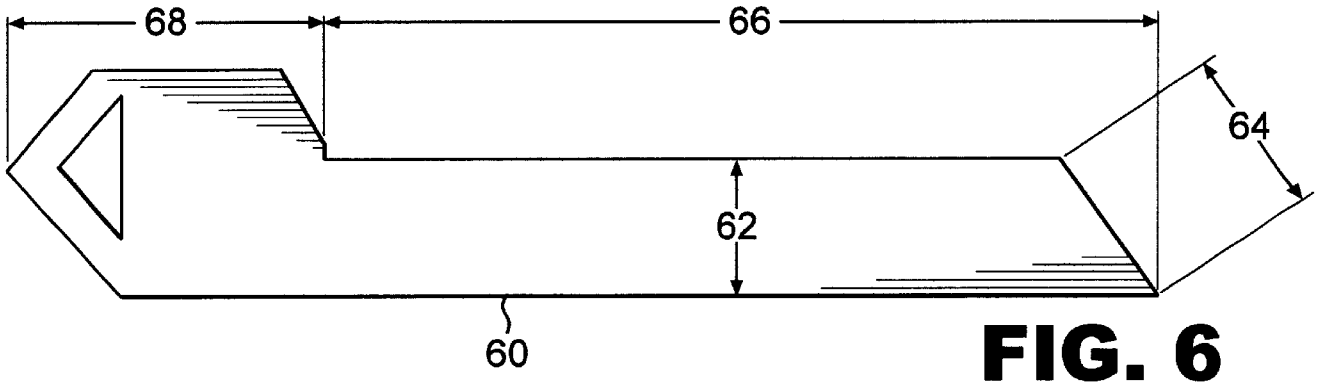
FIG. 6 shows a side view of an extractor.

It is understood that any device capable or raising the pins in a tumbler lock can be used to remove the keyhole block 30 from the lock 10. A preferred extractor is shown in FIG. 6. The extractor 60 of FIG. 6 can be used to facilitate removal of the keyhole block 30 from the lock 10 once the keyhole block 30 is installed. An extractor 60 may contain both an insertion portion 66 and a handle portion 68. The insertion portion 66 can be inserted into the keyway 16 while the keyhole block 30 is installed in the lock 10. Preferably, the insertion portion has a height 62 which corresponds to the remaining space 52 between the keyhole block 30 and the keyway 16, thereby allowing the insertion portion 66 to matingly interfit with the keyhole block 30, although the invention is not limited in this regard. The insertion portion 66 may also contain an angled tip 64 to aid the insertion portion 66 in raising fallen pins, such as pins 20*a*–20*d*.

The angled tip 64 of the insertion portion 66 may have an angle equal to that of the tip 38 of keyhole block 30, however, matching declination is not required. The handle portion 68 may be of any desired design or length. As illustrated in FIG. 6, the handle portion 68 may resemble a portion of the head of a conventional key used in the lock 10.

Figure 7:
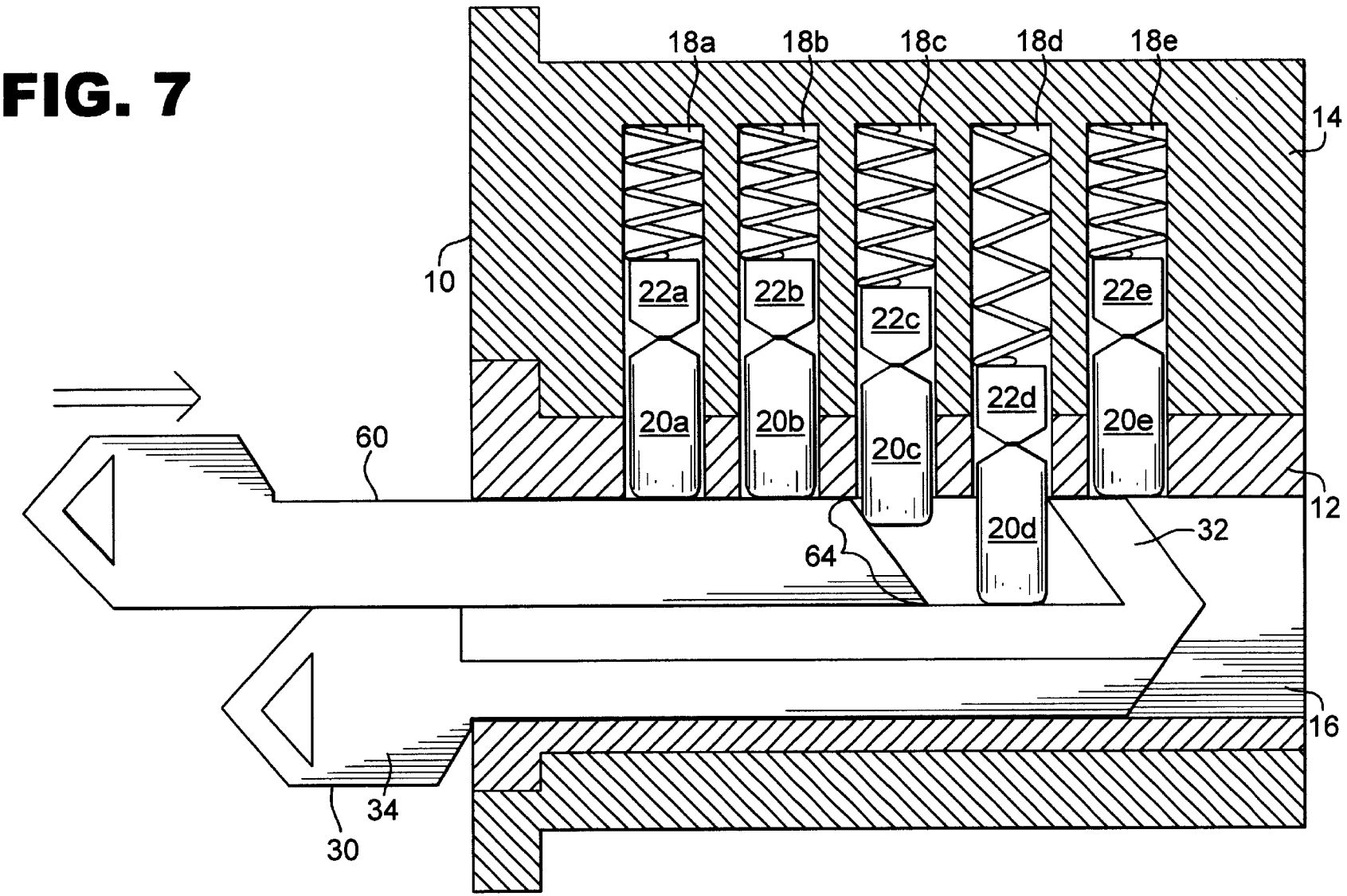
FIG. 7 shows the extractor of FIG. 6 during insertion into a lock.

FIG. 7 illustrates the operation of an extractor 60 to remove the installed keyhole block 30. The insertion portion 66 is first inserted into the keyway 16. The angled tip 64 of the extractor 60 raises the pins 20*a*–20*d* which have fallen down behind the retention portion 33 of the keyhole block 30. In this example, pins 20*a*–20*b* have been raised by the extractor 60 and pin 20*c* is in the process of being raised. The extractor 60 is inserted until all of the pins 20*a*–20*d* which are locked against the locking surface 37 of the retention portion 33 are raised by the insertion portion 66.

Figure 8:
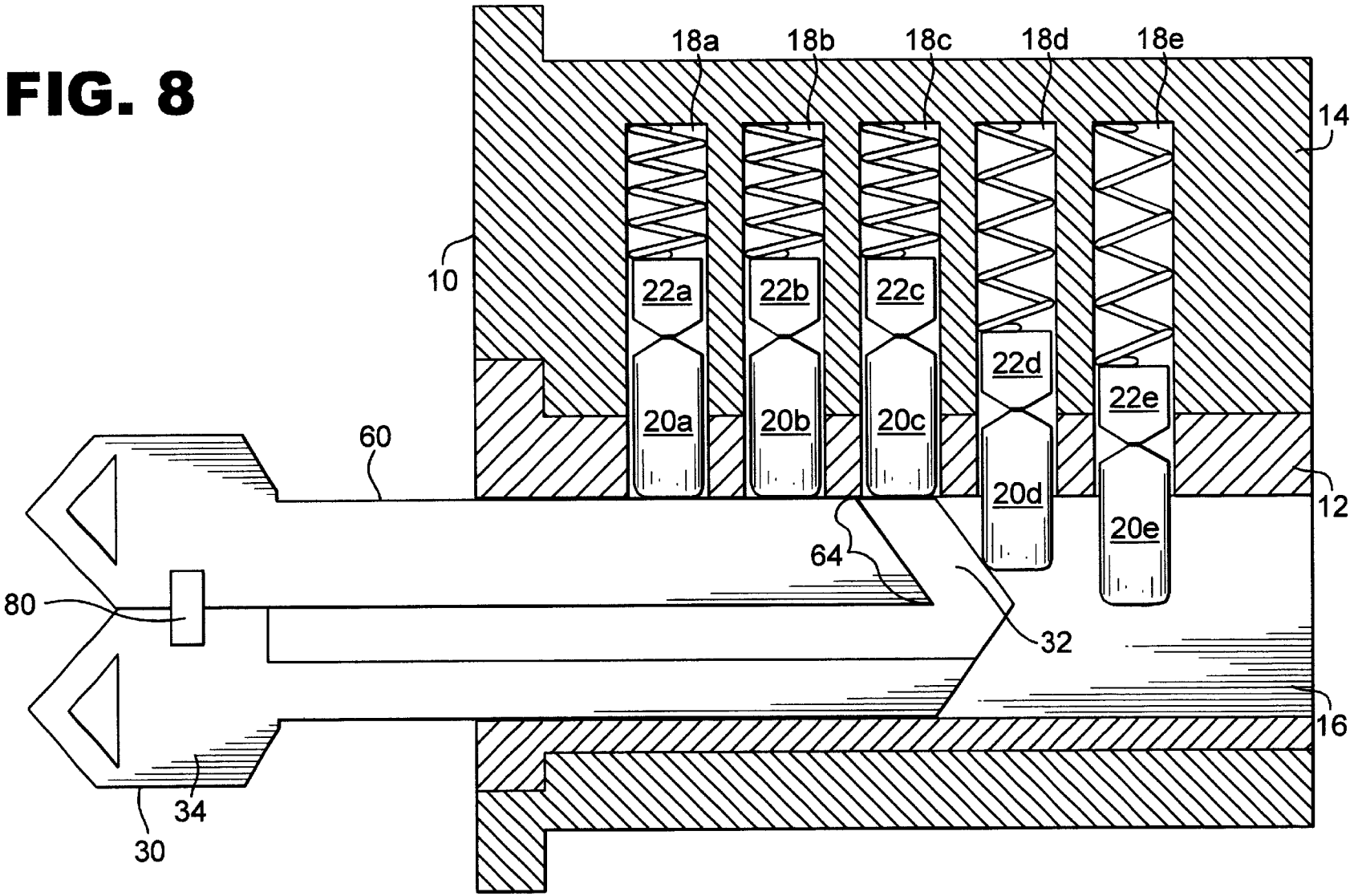
FIG. 8 shows the removal of the block of FIG. 3 and the extractor of FIG. 6 from a lock.

Upon insertion of the extractor 60, as illustrated in FIG. 8, the handle portion 68 of the extractor 60 and the signaling portion 34 are preferably in close proximity, providing an aid for retracting the extractor 60 and/or the signaling portion 34 from the keyway. An individual removing the keyhole block 30 can grip the handle portion 68 and the signaling portion 34 simultaneously for assistance in removing both the keyhole block 30 and the extractor 60. Therefore, in a preferred embodiment, once the pins 20*a*–20*d* are raised, both the keyhole block 30 and the extractor 60 may be concurrently removed from the keyway 16, as illustrated in FIG. 8. After removal of the keyhole block 30, the lock 10 may once again be operated using a conventional key (not shown).

The keyhole barrier system can include fastening structure. The fastening structure can be used to keep the keyhole block 30 within close proximity to the extractor 60 when the system is in a non-use state, such as in a tool box or a user's pocket. Thus, the fastening structure helps prevent the loss or separation of the various components of the system and also makes locating a complete system for installation faster. The fastening structure can be secured onto either the keyhole block 30 or the extractor 60.

The fastening structure can be any means capable of coupling the keyhole block 30 together with the extractor 60. Preferably, the fastening structure is a clip 80, as shown in FIG. 8. Alternatively, the fastening structure can be a snap device, a magnetic coupler, hook and loop fasteners, or a resealable adhesive fastener. Importantly, since the keyhole barrier system can be constructed from many different materials such as metal, plastic or wood, the fastening structure can be any structure capable of releaseably coupling the material used in the construction of the system.

It should be understood that the examples and embodiments described herein are for illustrative purposes only and that various modifications or changes in light thereof will be obvious to persons skilled in the art and are to be included within the spirit and purview of this application. Moreover, the invention can take other specific forms without departing from the spirit or essential attributes thereof.

What is claimed is:

1. A key hole barrier system for blocking a tumbler lock having a keyhole, a plurality of tumblers in the keyway and a lock surface outside of and surrounding an opening of the keyway, said system comprising:

a keyhole block having a retention portion for preventing removal of said keyhole block from the keyway, said retention portion having a longitudinal axis and adapted to be inserted into the keyway; and an external signaling portion, said signaling portion extending from said retention portion in a non-perpendicular manner relative to said longitudinal axis, whereby said signaling portion extends outwardly from the keyway when said keyhole block is inserted into the keyway and provides a readily observable warning to approaching observers that the keyhole is blocked.

2. The system according to claim 1, wherein said signaling portion has a signaling portion height and said retention portion height has an axial height and an elongated height, and said signaling portion height is greater than at least one of said axial height and said elongated height, whereby a readily visible warning is provided to an approaching observer.

3. The system according to claim 1, wherein said signaling portion extends substantially parallel to said longitudinal axis of said retention portion.

4. The system according to claim 1, wherein said signaling portion is visible laterally relative to said longitudinal axis of said retention portion.

5. The system according to claim 1, wherein said signaling portion extends substantially perpendicular to the lock surface.

6. The system according to claim 1, wherein said signaling portion includes attachment structure.

7. The system according to claim 6, wherein said attachment structure provides an aperture.

8. The system according to claim 1, wherein said retention portion has an angled tip.

9. The system according to claim 1, further comprising an extractor having a handle portion and a displacement portion, said displacement portion being capable of displacing tumblers in a tumbler lock.

10. The system according to claim 9, wherein said extractor matingly interfits with said keyhole block during retraction of said keyhole block from the keyway, thereby allowing withdrawal of said block from the keyway.

11. The system according to claim 10, wherein said keyhole block has a center edge, said center edge of said keyhole block matingly interfitting with an insertion portion of said extractor.

12. The system according to claim 9, wherein said handle portion is shaped to engage with said signaling portion, whereby said signaling portion and said handle portion combine in said engaged condition to provide a retraction aid.

13. The system according to claim 12, wherein at least one of said handle portion and said signaling portion includes fastening structure, whereby said handle portion and said signaling portion are releasably coupled in said engaged condition.

14. The system according to claim 1, further comprising a label connected to said signaling portion, said label providing a warning to avoid an area into which entry is precluded by said system.

15. The system according to claim 14, wherein said signaling portion has a label mount.

16. The system according to claim 15, wherein said label mount is unitarily constructed with said signaling portion.

17. The system according to claim 16, further comprising a label attached to said label mount, said label providing a warning to avoid an area into which entry is precluded by said system.

18. A method for forming a barrier in a tumbler lock keyhole, comprising the steps of:

providing a keyhole block having a retention portion, the retention portion comprising an elongated portion, a locking surface, a tip, a longitudinal axis and a signaling portion which once installed into a tumbler lock extends outwardly from the keyway of the lock;

inserting the keyhole block into the tumbler lock keyway; and allowing at least one pin of the tumbler lock to drop behind the tip and lock against the locking surface, whereby the keyhole block will prevent a conventional key from operating the tumbler lock while the keyhole block is inserted and provide a warning to observers approaching the lock from all directions that the lock is blocked.

19. The method according to claim 18, further comprising the step of providing a signaling portion having a height greater than either an axial height of the tip or an elongated portion height.

20. The method according to claim 18, further comprising the step of providing a signaling portion extending substantially parallel to the longitudinal axis of the retention portion.

21. The method according to claim 18, further comprising the step of providing a signaling portion which is visible laterally relative to a longitudinal axis of the retention portion.

22. The method according to claim 18, further comprising the step of providing a signaling portion which extends substantially perpendicular to the lock surface.

23. The method according to claim 18, further comprising the step of providing a warning label attached to the signaling portion of the keyhole block.

24. The method according to claim 18, further comprising the step of providing a keyhole block with a unitarily constructed label mount.

25. The method according to claim 18, further comprising the step of providing a warning label affixed to the signaling portion of the keyhole block.

26. The method according to claim 18, further comprising the step of providing a retention portion having an angled tip, wherein the angled tip facilitates raising pins of the tumbler lock.

27. The method according to claim 18, further comprising the step of providing an extractor having an insertion portion and a handle portion.

28. The method according to claim 27, wherein the extractor matingly interfits with the keyhole block and displaces the pins which have locked against the locking surface to allow removal of the keyhole block.

29. The method according to claim 27, further comprising the step of engaging the handle portion and the signaling portion to form a retraction aid.

30. The method according to claim 29, further comprising the step of gripping the retraction aid and removing both the keyhole block and extractor from the keyway.

31. The method according to claim 27, further comprising the step of providing fastening structure for at least one of the handle portion and the signaling portion.

* * * * *